US009061258B2

(12) United States Patent
Pang

(10) Patent No.: US 9,061,258 B2
(45) Date of Patent: Jun. 23, 2015

(54) PAINT CAN-CLAMPING DEVICE APPLICABLE TO DOUBLE-GYROSCOPIC MIXER

(71) Applicant: Jun Pang, Henan (CN)

(72) Inventor: Jun Pang, Henan (CN)

(73) Assignee: SHEN, RUHUA (CN)

( * ) Notice: Subject to any disclaimer, the term of this patent is extended or adjusted under 35 U.S.C. 154(b) by 165 days.

(21) Appl. No.: 13/867,457

(22) Filed: Apr. 22, 2013

(65) Prior Publication Data

US 2013/0286768 A1 Oct. 31, 2013

(30) Foreign Application Priority Data

Apr. 30, 2012 (CN) ..... 2012 2 0189997 U

(51) Int. Cl.
*B01F 15/00* (2006.01)
*B01F 9/00* (2006.01)

(52) U.S. Cl.
CPC ..... *B01F 15/00733* (2013.01); *B01F 9/0001* (2013.01); *B01F 15/00753* (2013.01)

(58) Field of Classification Search
CPC ..... B01F 11/0002; B01F 15/00733; B01F 15/00753
USPC ..... 366/110, 111, 114, 208–211, 217, 219, 366/605
See application file for complete search history.

(56) References Cited

U.S. PATENT DOCUMENTS 1,382,181 A * 6/1921 Emery ..... 74/86
1,755,763 A * 4/1930 Barber ..... 134/150
2,149,142 A * 2/1939 Jorgenson ..... 279/112
2,323,403 A * 7/1943 Jorgenson ..... 366/209
2,599,833 A * 6/1952 Holmlund ..... 70/58
2,797,902 A * 7/1957 Beugler ..... 366/217
2,894,309 A * 7/1959 Brzowski ..... 24/569
3,710,507 A * 1/1973 Poynter ..... 446/74
3,880,408 A * 4/1975 Karjalainen ..... 366/217
4,134,689 A * 1/1979 Ahrenskou-Sorensen .... 366/110
4,281,936 A * 8/1981 Schotter et al. ..... 366/209
4,445,782 A * 5/1984 Sparrow, Jr. ..... 366/217
4,568,194 A * 2/1986 Gargioni ..... 366/213
4,588,302 A * 5/1986 Pizzi et al. ..... 366/349
4,619,532 A * 10/1986 Schmidt, III ..... 366/110
4,789,245 A * 12/1988 Morbeck ..... 366/217
4,834,548 A * 5/1989 Tempel et al. ..... 366/208

(Continued)

FOREIGN PATENT DOCUMENTS

CN 200920089170.6 2/2010
DE 3111437 A1 * 10/1982 ..... B01F 9/00

(Continued)

*Primary Examiner* — Charles Cooley
(74) *Attorney, Agent, or Firm* — Cantor Colburn LLP

(57) ABSTRACT

A paint can-clamping device applicable to a double-gyroscopic mixer is disclosed, including a lower supporting plate, left and right guide rails, an upper pressing plate and a locking mechanism. The locking mechanism includes an upper pressing plate-fixing frame, a locking piece and a locking piece spring. The upper pressing plate is connected to the upper pressing plate-fixing frame via a guide pole. A cam structure having a cam handle is mounted in the upper pressing plate-fixing frame, and is cooperated, via a cam pressing mechanism for pressing the locking piece downwardly, with the locking piece such that the locking piece moves away from the V-shaped groove of the guide rail to be in unlocking state, thereby achieving a linear movement of the upper pressing plate along the guide rails.

5 Claims, 10 Drawing Sheets

(56) References Cited

U.S. PATENT DOCUMENTS

| | | | | | |
|---|---|---|---|---|---|
| 4,842,415 | A * | 6/1989 | Cane et al. | 366/110 |
| 5,066,136 | A * | 11/1991 | Johnson | 366/209 |
| 5,197,802 | A * | 3/1993 | Miller et al. | 366/217 |
| 5,261,744 | A * | 11/1993 | Brunn | 366/217 |
| 5,268,620 | A * | 12/1993 | Hellenberg | 318/114 |
| 5,310,257 | A * | 5/1994 | Altieri et al. | 366/208 |
| 5,383,163 | A * | 1/1995 | Brunn | 366/217 |
| 5,458,416 | A * | 10/1995 | Edwards et al. | 366/209 |
| 5,462,353 | A * | 10/1995 | Gatlin | 366/209 |
| 5,507,575 | A * | 4/1996 | Rossetti | 366/217 |
| 5,662,416 | A * | 9/1997 | Dwigans, II | 366/209 |
| 5,711,601 | A * | 1/1998 | Thomas et al. | 366/209 |
| 5,749,652 | A * | 5/1998 | Brunn et al. | 366/209 |
| 5,788,371 | A * | 8/1998 | Neri et al. | 366/217 |
| 5,897,204 | A * | 4/1999 | Dittmer et al. | 366/209 |
| 5,904,421 | A * | 5/1999 | Mazzalveri | 366/213 |
| 5,906,433 | A * | 5/1999 | Mazzalveri | 366/209 |
| 6,318,889 | B1 * | 11/2001 | Hansen, Sr. | 366/286 |
| 6,827,480 | B2 * | 12/2004 | Morselli | 366/209 |
| 6,850,020 | B1 * | 2/2005 | Midas et al. | 318/286 |
| 6,883,955 | B2 * | 4/2005 | Salas et al. | 366/110 |
| 6,945,689 | B2 * | 9/2005 | Armendariz et al. | 366/209 |
| 6,945,690 | B2 * | 9/2005 | Armendariz et al. | 366/209 |
| 7,165,879 | B2 * | 1/2007 | Midas et al. | 366/209 |
| 7,300,198 | B2 * | 11/2007 | Khoo et al. | 366/209 |
| 7,306,363 | B2 * | 12/2007 | Manke | 366/214 |
| 7,311,437 | B2 * | 12/2007 | Midas et al. | 366/217 |
| 7,344,300 | B2 * | 3/2008 | Midas et al. | 366/209 |
| 7,399,111 | B2 * | 7/2008 | MacDonald et al. | 366/110 |
| 7,517,136 | B2 * | 4/2009 | Marrazzi et al. | 366/209 |
| 7,717,614 | B2 * | 5/2010 | Miller | 366/209 |
| 7,819,577 | B2 * | 10/2010 | Greco et al. | 366/209 |
| 7,890,213 | B2 * | 2/2011 | Greco et al. | 700/265 |
| 2004/0008573 | A1 * | 1/2004 | MacDonald et al. | 366/209 |
| 2004/0013031 | A1 * | 1/2004 | Salas et al. | 366/141 |
| 2004/0100863 | A1 * | 5/2004 | Morselli | 366/209 |
| 2004/0202045 | A1 * | 10/2004 | Marazzi et al. | 366/209 |
| 2005/0088911 | A1 * | 4/2005 | Sordelli et al. | 366/217 |
| 2005/0169102 | A1 * | 8/2005 | Manke | 366/209 |
| 2005/0213426 | A1 * | 9/2005 | Midas et al. | 366/209 |
| 2005/0286341 | A1 * | 12/2005 | Midas et al. | 366/217 |
| 2006/0077754 | A1 * | 4/2006 | Bressani et al. | 366/209 |
| 2007/0081416 | A1 * | 4/2007 | Midas et al. | 366/209 |
| 2007/0081417 | A1 * | 4/2007 | Midas et al. | 366/209 |
| 2007/0081418 | A1 * | 4/2007 | Midas et al. | 366/209 |
| 2007/0211561 | A1 * | 9/2007 | Page | 366/113 |
| 2007/0211567 | A1 * | 9/2007 | Miller | 366/209 |
| 2007/0211568 | A1 * | 9/2007 | Lowan et al. | 366/209 |
| 2007/0211569 | A1 * | 9/2007 | Khoo et al. | 366/209 |
| 2008/0008027 | A1 * | 1/2008 | Midas et al. | 366/209 |
| 2008/0089172 | A1 * | 4/2008 | Manke | 366/214 |
| 2008/0267007 | A1 * | 10/2008 | Bressani et al. | 366/211 |
| 2008/0269950 | A1 * | 10/2008 | Greco et al. | 700/265 |
| 2009/0190437 | A1 * | 7/2009 | Greco et al. | 366/209 |
| 2010/0074047 | A1 * | 3/2010 | Benatti et al. | 366/213 |
| 2012/0201093 | A1 * | 8/2012 | Curtis et al. | 366/213 |
| 2013/0264760 | A1 * | 10/2013 | Johnson et al. | 269/89 |
| 2013/0286768 | A1 * | 10/2013 | Pang | 366/217 |

FOREIGN PATENT DOCUMENTS

| | | | | |
|---|---|---|---|---|
| DE | 3153103 | C2 * | 1/1986 | B01F 9/00 |
| DE | 4416593 | C1 * | 9/1995 | B01F 9/00 |
| DE | 3706002 | C2 * | 4/1996 | |
| DE | 19611546 | C1 * | 8/1997 | |
| EP | 617998 | A1 * | 10/1994 | B01F 11/00 |
| GB | 1446151 | A * | 8/1976 | |
| GB | 1586953 | A * | 3/1981 | |
| GB | 2096909 | A * | 10/1982 | B01F 9/02 |
| GB | 2129323 | A * | 5/1984 | |
| GB | 2192138 | A * | 1/1988 | B01F 11/00 |
| WO | WO 9108045 | A1 * | 6/1991 | B01F 9/00 |
| WO | WO 9415704 | A1 * | 7/1994 | |
| WO | WO 9613323 | A1 * | 5/1996 | B01F 11/00 |

* cited by examiner

Fig.2（Prior Art）

PAINT CAN-CLAMPING DEVICE APPLICABLE TO DOUBLE-GYROSCOPIC MIXER

This application claims the benefit of priority to Chinese Patent Application No. 201220189997.6, titled "PANT CAN-CLAMPING DEVICE APPLICABLE TO DOUBLE-GYROSCOPIC MIXER", filed with the Chinese State Intellectual Property Office on Apr. 30, 2012, the entire disclosure of which is incorporated herein by reference.

FIELD OF THE INVENTION

The present application relates to the field of paint mixing and color matching, and in particular to a paint can-clamping device applicable to a double-gyroscopic mixer which may perform paint mixing process for not only a circular can but also a square can.

BACKGROUND OF THE INVENTION

Presently, a double-gyroscopic mixer is available in the market, in which a paint can fixing device is obliquely provided. The double-gyroscopic mixer is specifically used for mixing paints in the paint can. By revolution (that is, the paint can is rotated about an axis, namely a revolution axis, which forms an angle with the geometrical axis of the paint can) and rotation (that is, the paint can is rotated about its own geometrical axis, namely a rotation axis), an ideal mixing effect may be achieved. At present, circular cans and square cans are commonly found. Accordingly, the paint can fixing device also includes circular paint can fixing devices and square paint can fixing devices applied to circular paint cans and square paint cans respectively. The present applicant filed a Chinese patent application No. 200920089170.6, titled "paint can-fixing device applicable to double-gyroscopic mixer" on Mar. 25, 2009, as shown in FIGS. 1 and 2. With the cooperation between a locking piece and a V-shaped groove of a guide rail, the upper pressing plate is slidable along the guide rail freely by grasping a pressing handle, and then, the secondary pressing device is rotated, so that the paint can between the upper pressing plate and the lower supporting plate can be clamped completely by the straight line stroke of the threads. At this moment, the machine can be actuated to mix the paints safely.

At present, such a paint can-fixing device of the double-gyroscopic mixer can effectively perform a mixing process for both the circular paint can and the square paint can having various dimensions. The friction cooperation between the locking piece and the V-shaped groove is safe and reliable, which effectively solves the problem of the falling of the paint can during the mixing process. Thus, the paint can-fixing device has a simple structure, and is safe and reliable. The prior technical solution includes two separate steps: pushing the upper pressing plate to slide along the guide rail so as to pre-tighten the paint can, and rotating the pressing spanner such that the paint can is clamped for the second time. Therefore, a technical solution having a simple structure and fewer operation steps would be desirable in the art.

SUMMARY OF THE INVENTION

In view of the above reasons, an object of the present application is to provide a paint can-clamping device applicable to a double-gyroscopic mixer, which has a simple structure and is convenient to operate. In the clamping device, a cam pressing structure is provided to press the paint can and easily enable a locking piece to be in unlocking state.

The object of the present application is achieved via the following technical solutions.

A paint can-clamping device applicable to a double-gyroscopic mixer includes a lower supporting plate, left and right guide rails fixed on the lower supporting plate, and an upper pressing plate mounted on the left and right guide rails via a locking mechanism and being movable up and down along the guide rails. The locking mechanism includes an upper pressing plate-fixing frame, a locking piece and a locking piece spring. The locking piece is located in the upper pressing plate-fixing frame, with the front end thereof is in contact and cooperated with the guide rail and having an arc surface. A rotary shaft is mounted in the front end of the locking piece, and the arc surface of the front end of the locking piece is eccentric with respect to the rotary shaft at the front end of the locking piece such that the arc surface of the front end of the locking piece is rotatable eccentrically about the rotary shaft. The locking piece is in friction cooperation with a V-shaped groove in the guide rail. The upper pressing plate is connected to the upper pressing plate-fixing frame via a guide pole, such that the upper pressing plate is movable linearly with respect to the upper pressing plate-fixing frame along an axis direction of the guide pole. A cam structure having a cam handle is mounted in the upper pressing plate-fixing frame. The cam structure is cooperated, via a cam pressing mechanism for pressing the locking piece downwardly, with the locking piece, such that the locking piece move away from the V-shaped grooves of the guide rails to be in unlocking state, thereby achieving a linear movement of the upper pressing plate along the guide rails. A surface of the cam structure is cooperated with the top surface of the upper pressing plate in a sliding friction manner, and is configured such that the friction point on the contour curve of the cam moves from the nearest base circle end to the fastest end when the cam handle is rotated from a vertical state to a horizontal state.

In the present application, the upper pressing plate is connected to the upper pressing plate-fixing frame via four symmetrical guide poles. The guide poles are fixed on the upper pressing plate, and each guide pole is provided thereon with a spring such that the upper pressing plate is located closest to the upper pressing plate-fixing frame under the force of the spring when the upper pressing plate is free from the pressure of the cam.

The cam structure is fixedly mounted via a rotary shaft on the upper pressing plate-fixing frame and is rotatable about the rotary shaft.

The cam pressing mechanism for pressing the locking piece downwardly may have the following two designs.

The cam pressing mechanism may be designed to include the cam structure and a flange provided on the cam structure and extending towards two sides of the cam structure. The flange is cooperated with a distal end of the locking piece in a sliding friction manner. When the cam handle is rotated, the flange can press the distal end of the locking piece downwardly, so that the locking piece moves away from the V-shaped groove of the guide rail to be in unlocking state.

Alternatively, the cam pressing mechanism may be designed to include a pressing pole mounted on the cam structure and a U-shaped pressing pole mounted in the upper pressing plate-fixing frame. Both ends of the U-shaped pressing pole are rotatable in the upper pressing plate-fixing frame, and the U-shaped pressing pole is cooperated with a distal end of the locking piece in sliding friction manner. When the cam handle is rotated, the bottom portion of the U-shaped pressing pole is pressed downwardly by the pressing pole on the cam structure, so that the U-shaped pressing pole just presses the distal end of the locking piece downwardly, and thus the locking piece moves away from the V-shaped groove of the guide rail to be in unlocking state.

The present application is featured to effectively utilize a lifting distance caused by the rotation of the cam so as to achieve the linear movement of the upper pressing plate in contact with the contour curve of the cam as a driven member, thereby achieving a secondary pressing against the paint can. The operation is convenient, quick, safe and reliable.

Figure 1:
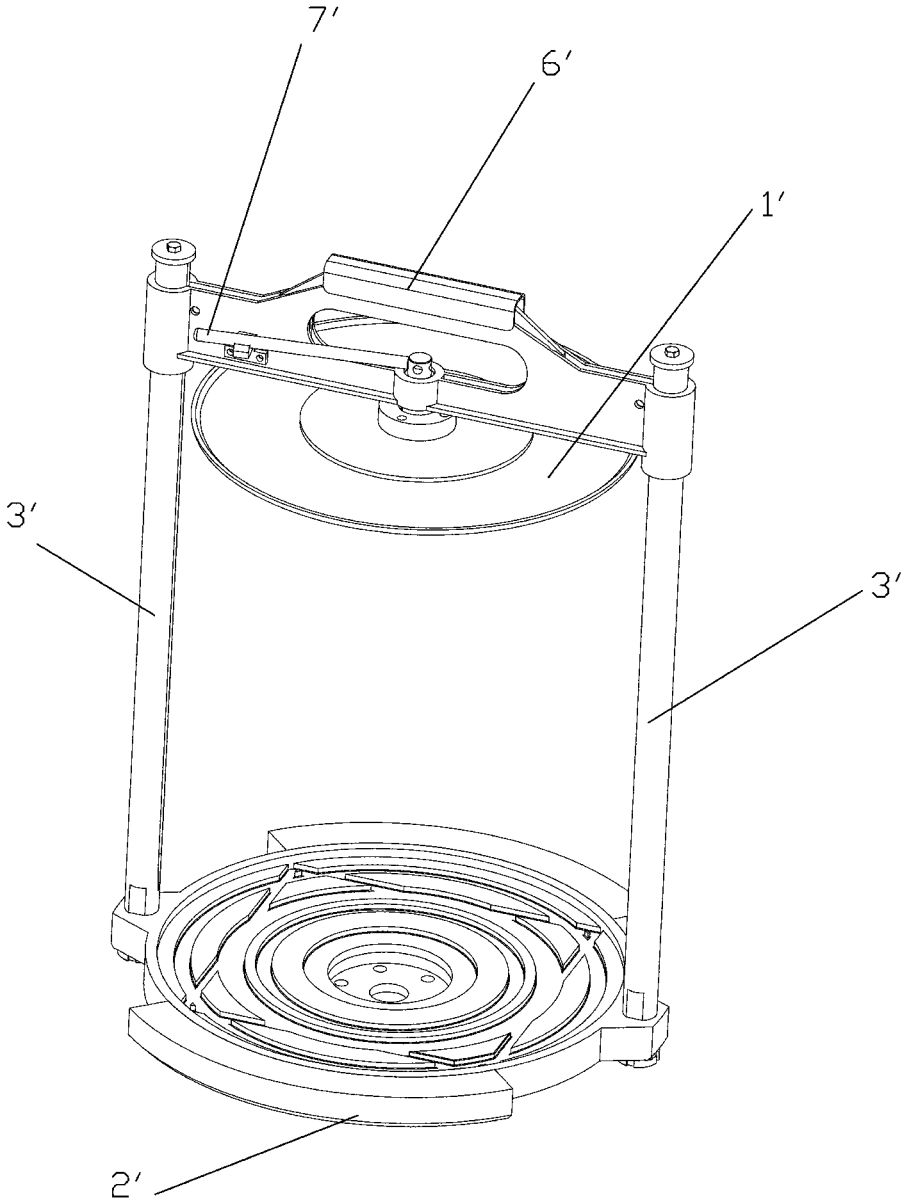
Fig.1(Prior Art)
FIG. 1 is a schematic view of a paint can-clamping device in the prior art (Patent Application No. CN200920089170.6)
Figure 2:
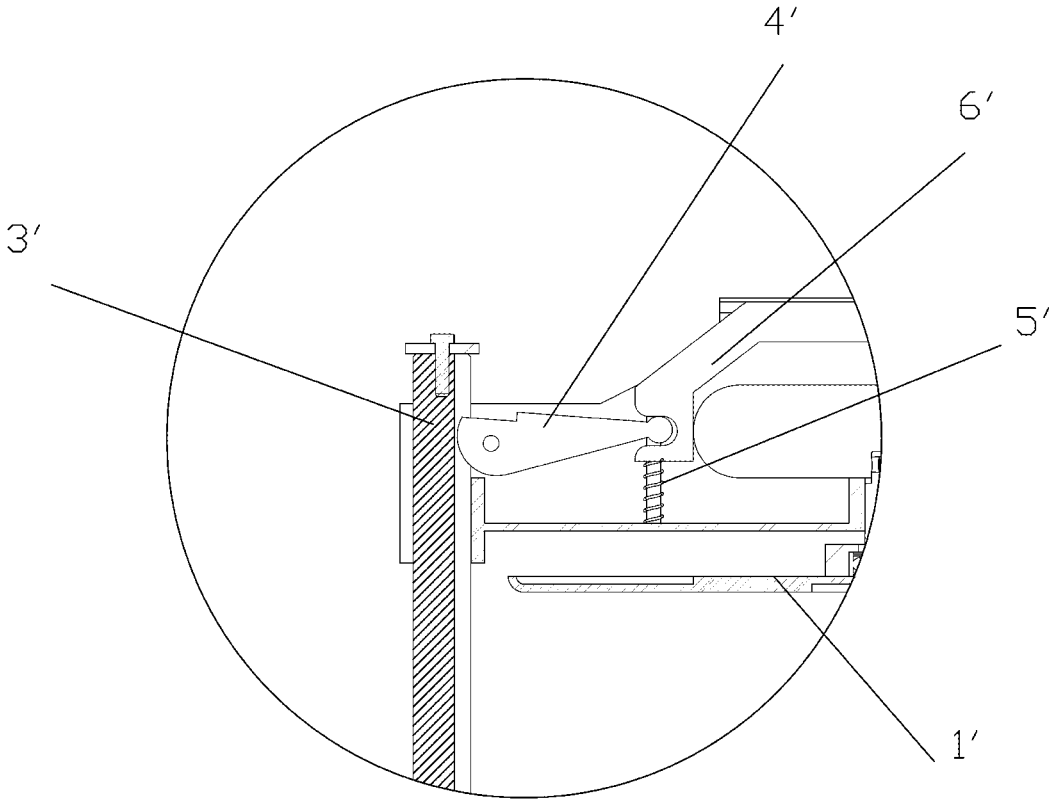
FIG. 2 is a partial schematic view of a pressing mechanism in FIG. 1.

Reference numbers in Figures:

| | | |
|---|---|---|
| 1' upper pressing plate, | 2' lower supporting plate, | 3' guide rail, |
| 4' locking piece, | 5' locking spring, | 6' pressing handle, |
| 7' secondary pressing spanner; | | |
| 1. upper pressing plate, | | 2. lower supporting plate, |
| 3. guide rail, | | 4. locking piece, |
| 4-1. locking piece rotary shaft, | | 4-2. front end of locking piece, |
| 4-3. distal end of locking piece, | | 5. locking piece spring, |
| 6. cam structure, | | 6-1. flange of cam structure, |
| 6-2. pressing pole, | | 7. cam handle, |
| 8. cam rotary shaft, | | 9. U-shaped pressing pole, |
| 9-1. bottom portion of U-shaped pressing pole, | | 10. upper pressing plate-fixing frame, |
| 11. guide pole, | 12. spring, | 13. fixing block of locking piece. |

DETAILED DESCRIPTION OF THE INVENTION

The present application will be described in conjunction with the accompanying drawings hereinafter.

As shown in FIGS. 3 to 12, a paint can-clamping device applicable to a double-gyroscopic mixer according to the present application includes a lower supporting plate 2, left and right guide rails 3 fixed on the lower supporting plate 2, and an upper pressing plate 1 mounted on the left and right guide rails via a locking mechanism and being movable up and down along the guide rails. The locking mechanism includes an upper pressing plate-fixing frame 10, a locking piece 4 and a locking piece spring 5. The locking piece 4 is located in the upper pressing plate-fixing frame 10, and a front end 4-2 of the locking piece is contact fitted with the guide rail 3. The front end 4-2 of the locking piece has an arc surface, and a rotary shaft 4-1 is installed in the front end of the locking piece. The arc surface of the front end of the locking piece is eccentric with respect to the rotary shaft 4-1 at the front end of the locking piece, so that the arc surface of the front end of the locking piece is rotatable eccentrically about the rotary shaft 4-1 at the front end of the locking piece. The eccentric rotation can drive the arc surface of the front end of the locking piece to press against the V-shaped groove in a case that the arc surface of the front end of the locking piece is rotated downwards about the shaft 4-1. The locking piece 4 is in friction cooperation with the V-shaped groove in the guide rail 3. Meanwhile, the upper pressing plate 1 is connected to the upper pressing plate-fixing frame 10 via a guide pole 11, and is movable linearly, with respect to the upper pressing plate-fixing frame, in a guide hole of the upper pressing plate-fixing frame along an axis direction of the guide pole. A cam structure 6 having a cam handle 7 is mounted in the upper pressing plate-fixing frame, and is cooperated, via a cam pressing mechanism for pressing the locking piece 4 downwardly, with the locking piece such that the locking piece moves away from the V-shaped groove of the guide rail to be in unlocking state. In this case, the upper pressing plate 1 is movable linearly along the guide rail. In addition, a surface of the cam structure is capable of sliding friction against the top surface of the upper pressing plate, and is configured such that the friction point on the contour curve of the cam moves from the nearest base circle end to the fastest end when the cam handle is rotated from a vertical state to a horizontal state, thereby forcing the upper pressing plate and the guide pole to move downwardly.

In the present application, the upper pressing plate 1 is connected to the upper pressing plate-fixing frame 10 via four symmetrical guide poles 11. The guide poles are fixed on the upper pressing plate, and are each provided thereon with a spring 12 such that the upper pressing plate is located closest to the upper pressing plate-fixing frame under the force of the spring when the upper pressing plate is free from the pressure of the cam.

The cam structure 6 is fixedly installed, via a rotary shaft 8, on the upper pressing plate-fixing frame 10 and is rotatable about the rotary shaft 8.

The pressing mechanism for pressing the locking piece 4 downwardly may have the following two designs.

Figure 3:
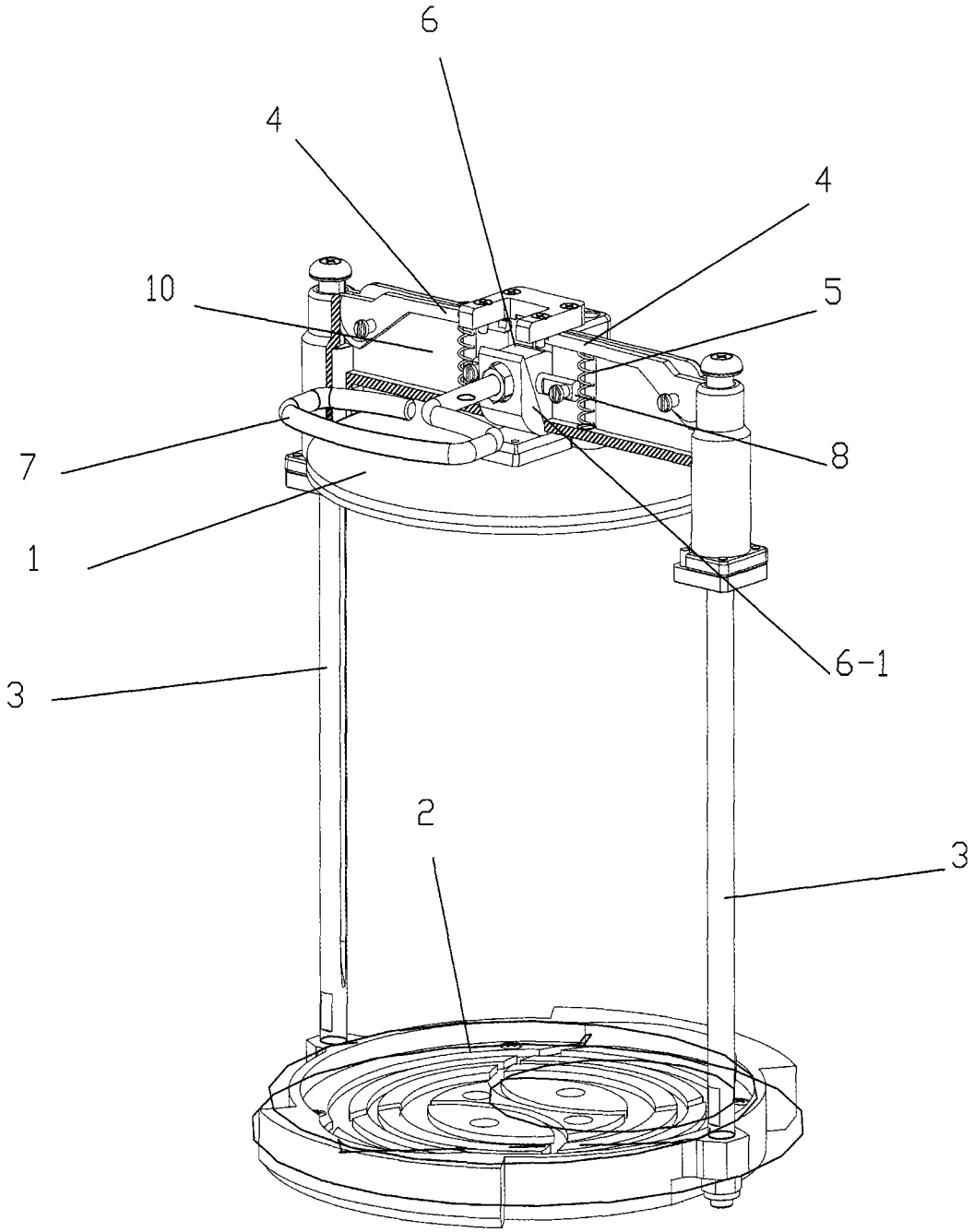
FIG. 3 is an isometric view of a pressing and fixing device according to the present application (in a clamped state, with a pressing and fixing frame being cut away)
Figure 4:
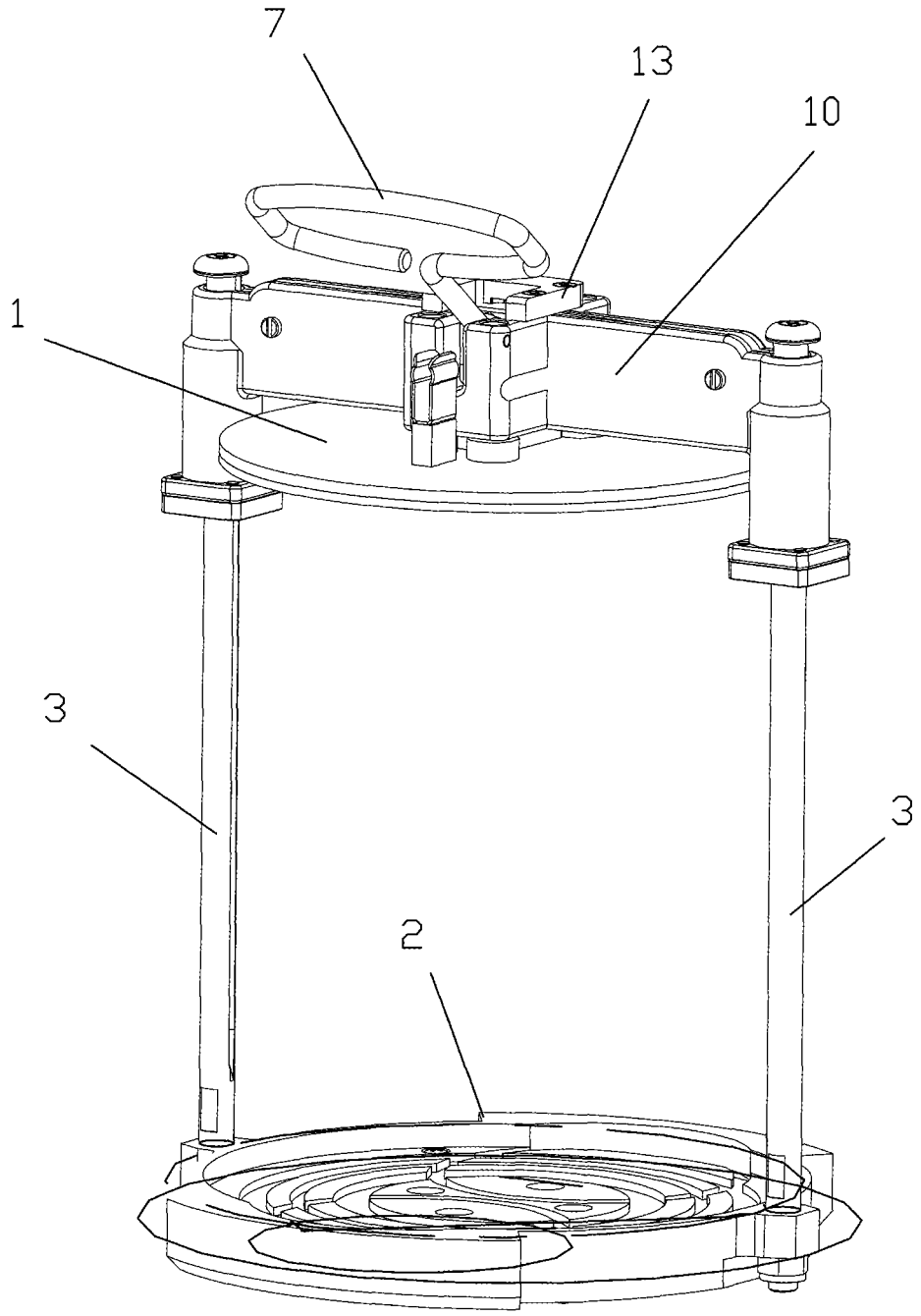
FIG. 4 an isometric view of the pressing and fixing device according to the present application in FIG. 3 (in a half opened state)
Figure 5:
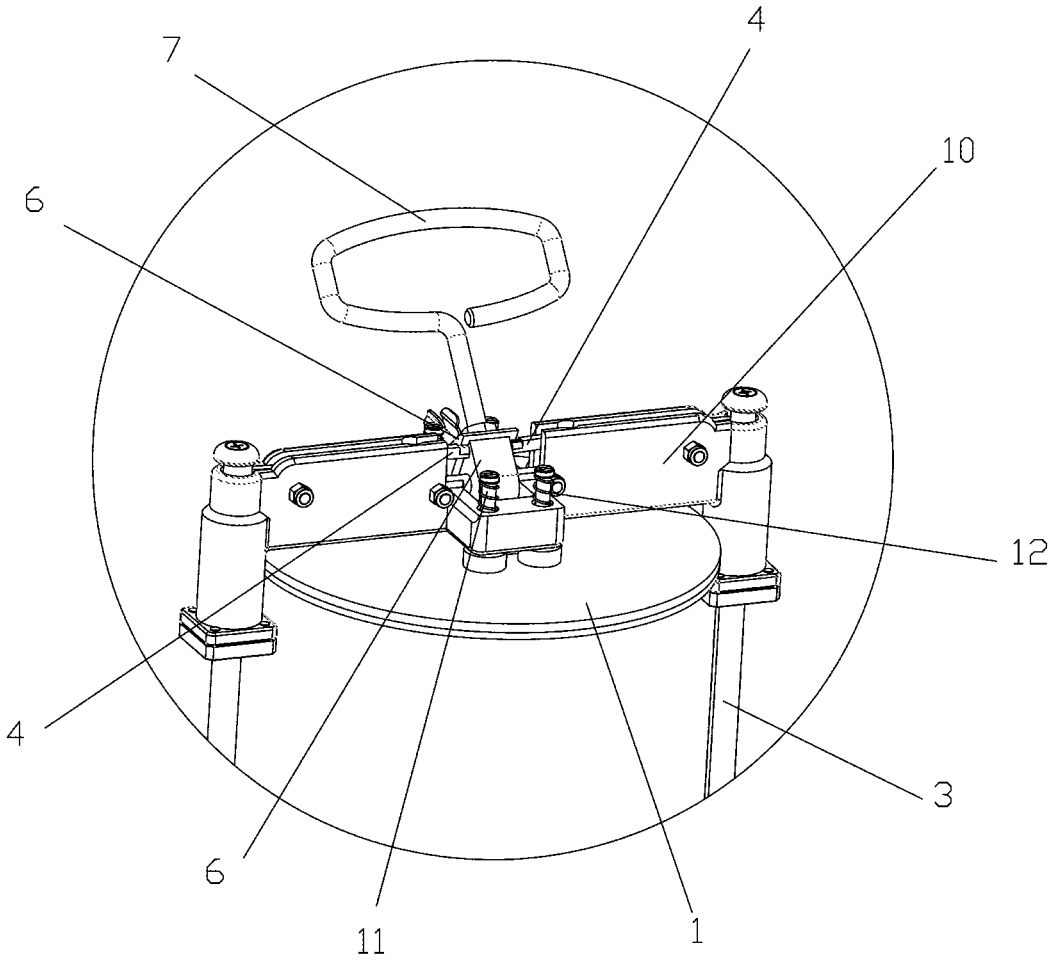
FIG. 5 is a partial isometric view of the pressing and fixing device of FIG. 3 in an opened state viewing from the back side (with the pressing and fixing frame being cut away)
Figure 9:
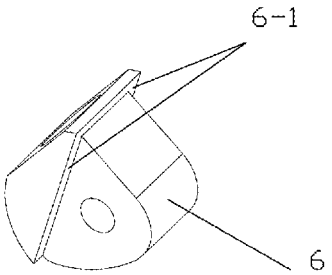
FIG. 9 is an isometric view of a cam structure provided with a flange.

As shown in FIGS. 3, 5 and 9, the pressing mechanism may be designed to include the cam structure 6 and a flange 6-1 provided on the cam structure and extending towards two sides of the cam structure. The flange is cooperated with the distal end 4-3 of the locking piece in a sliding friction manner.

When the cam handle 7 is rotated and pulled up, the flange 6-1 can press the distal end 4-3 of the locking piece downwardly, so that the locking piece 4 moves away from the V-shaped groove of the guide rail to be in unlocking state.

When the cam handle 7 is rotated towards the body of an operator and is pressed downwardly, the flange 6-1 is raised, and the distal end 4-3 of the locking piece is pushed up under the force of the locking piece spring. Meanwhile, the arc surface of the front end of the locking piece is rotated eccentrically about the rotary shaft. The eccentric rotation can drive the arc surface of the front end of the locking piece to press against the V-shaped groove while being rotated downwards about the shaft 4-1, so that the friction and pressure between the locking piece 4 and the V-shaped groove of the guide rail may lock the upper pressing plate-fixing frame.

As shown in FIGS. 6, 7, 8, and 10, the pressing mechanism may be designed to include the pressing pole 6-2 mounted on the cam structure and the U-shaped pressing pole 9 sandwiched in the upper pressing plate-fixing frame 10. Both ends of the U-shaped pressing pole are rotatable in the upper pressing plate-fixing frame, and the U-shaped pressing pole 9 is cooperated with the distal end 4-3 of the locking piece in sliding friction manner. When the cam handle 7 is rotated and is pulled up, the bottom portion 9-1 of the U-shaped pressing pole is pressed downwardly by the pressing pole 6-2 on the cam structure, so that the U-shaped pressing pole 9 just presses the distal end 4-3 of the locking piece 4 downwardly, and thus the locking piece moves away from the V-shaped groove of the guide rail to be in unlocking state.

When the cam handle 7 is rotated towards the body of an operator and is pressed downwardly, the pressing pole 6-2 on the cam structure is rotated and raised upwardly so as to separate from the bottom portion 9-1 of the U-shaped pressing pole, such that the distal end 4-3 of the locking piece pressed by the U-shaped pressing pole 9 is pulled up under the force of the locking piece spring. Meanwhile, the arc surface of the front end of the locking piece is rotated eccentrically about the rotary shaft. The eccentric rotation can drive the arc surface of the front end of the locking piece to press against the V-shaped groove while being rotated downwards about the shaft 4-1, so that the friction and pressure between the locking piece 4 and the V-shaped groove of the guide rail may lock the upper pressing plate-fixing frame.

The operation principle and process of the present application will be described in conjunction with the accompanying figures hereinafter.

As shown in FIG. 5, the upper pressing plate is connected to the upper pressing plate-fixing frame via four symmetrical guide poles, and the lower end of each guide pole is fixedly connected with the upper pressing plate. The guide pole is mounted in the upper pressing plate-fixing frame. The upper pressing plate is movable up and down linearly along the guide poles under the upper pressing plate-fixing frame, and each guide pole is provided thereon with a spring, with the upper end of the spring being mounted at the upper end of the guide pole and the lower end thereof abutting against the upper pressing plate. The elastic force and length of the spring are configured such that the distance between the top surface of the upper pressing plate and the bottom surface of the upper pressing plate-fixing frame is minimum when no external force is applied to the upper pressing plate.

As shown in FIGS. 3, 5, 6, 7 and 8, a cam structure is mounted in the upper pressing plate-fixing frame. Specifically, the cam structure is mounted in the upper pressing plate-fixing frame via a rotary shaft. The cam structure is rotatable about the rotary shaft. A cam handle is fixedly mounted at one end of the cam structure. A surface of the cam structure is in contact and cooperated with the top surface of the upper pressing plate in sliding friction manner, and is configured such that the friction point on the contour curve of the cam moves from the nearest base circle end to the fastest end when the cam handle is rotated from a vertical state to a horizontal state, thereby achieving a linear lifting distance.

When the cam handle is rotated from the vertical state to the horizontal state, the top surface of the upper pressing plate is cooperated with the cam structure in sliding friction manner. In this way, the cam structure may move from the nearest base circle position to the fastest base circle position, and meanwhile, the upper pressing plate may be moved linearly and downwardly along the guide pole.

When the cam handle is rotated from the horizontal state to the vertical state, the top surface of the upper pressing plate is cooperated with the cam structure in sliding friction manner. In this way, the cam structure may be moved from the fastest base circle position to the nearest base circle position, and the upper pressing plate may be moved upwardly and linearly along the guide pole under the tension of the spring provided on the guide pole.

In a solution for unlocking the upper pressing plate from the guide rail by the locking piece, the cam structure as shown in FIG. 9 is provided in an embodiment of the present application, with the assembled structure being shown in FIGS. 3 and 5. In the present structure, the upper end surface of the cam structure is provided with an outer flange structure extending towards two sides, and the length of the flange structure is configured such that, when the cam handle is rotated upwardly, the distal end of the locking piece is pressed downwardly by the flange structure extending towards two sides and is cooperated with the same in sliding friction manner. Since the flange structure extending from two ends of the cam is eccentric with respect to the base circle, when the cam handle is rotated to the vertical state, the rotation travel of the flange structure forces the distal end of the locking piece to rotate downwardly, so that the front end of the locking piece moves away from the V-shaped groove of the guide rail to be in unlocking state.

Figure 6:
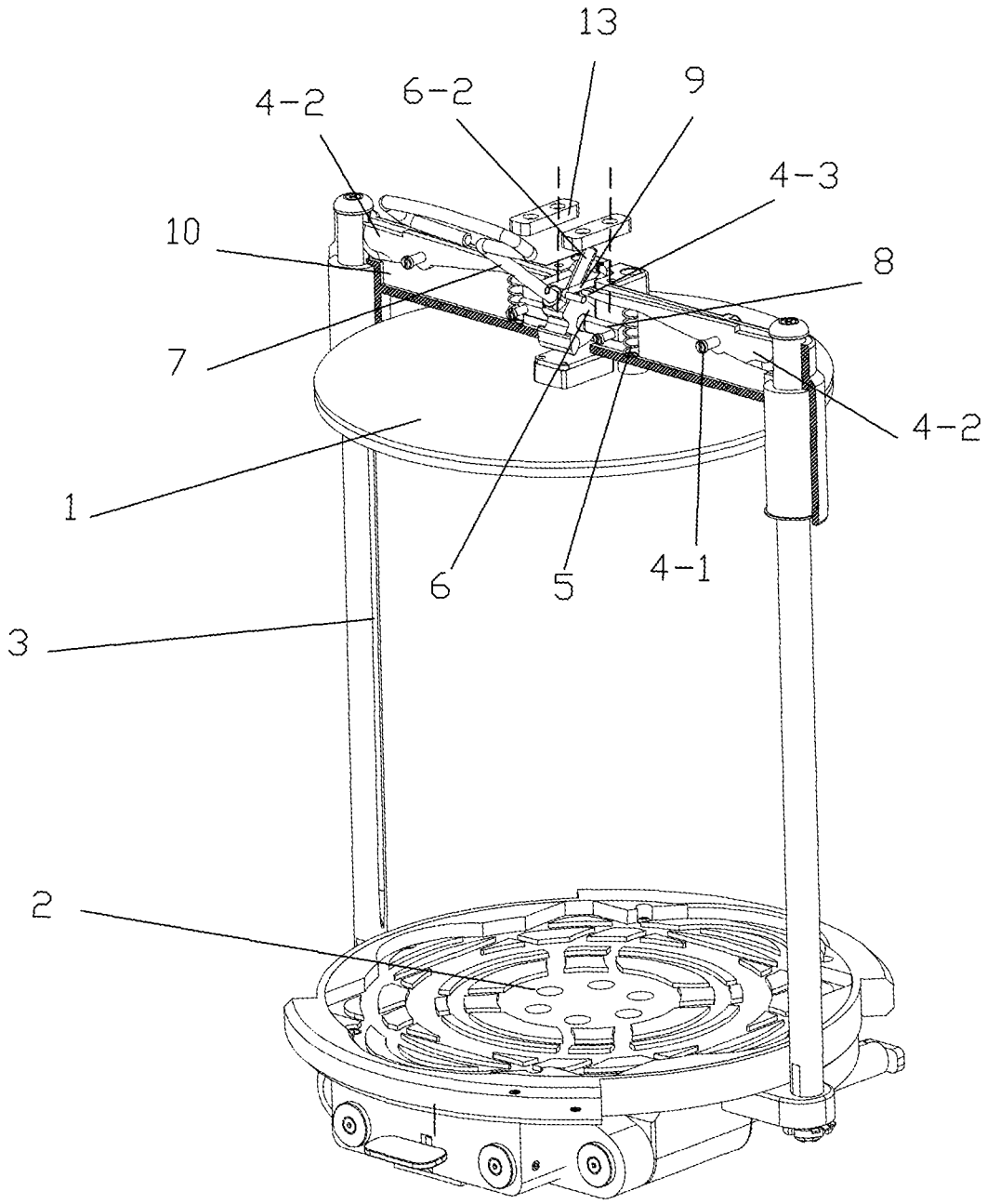
FIG. 6 is an isometric view of another pressing and fixing device according to the present application (in a clamped state, with a pressing and fixing frame being cut away)
Figure 7:
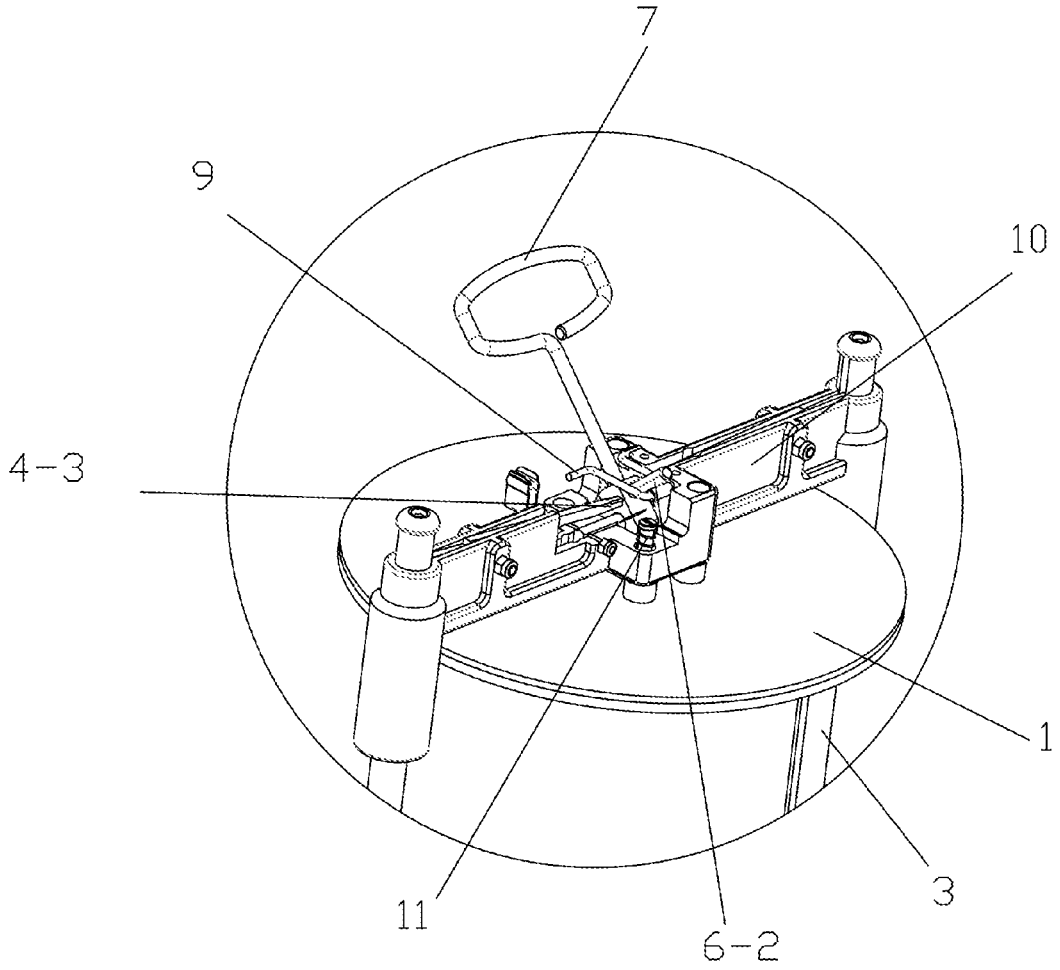
FIG. 7 is a schematic view showing the cooperation between a cam structure and a locking piece of FIG. 6 and viewing from the back side.
Figure 8:
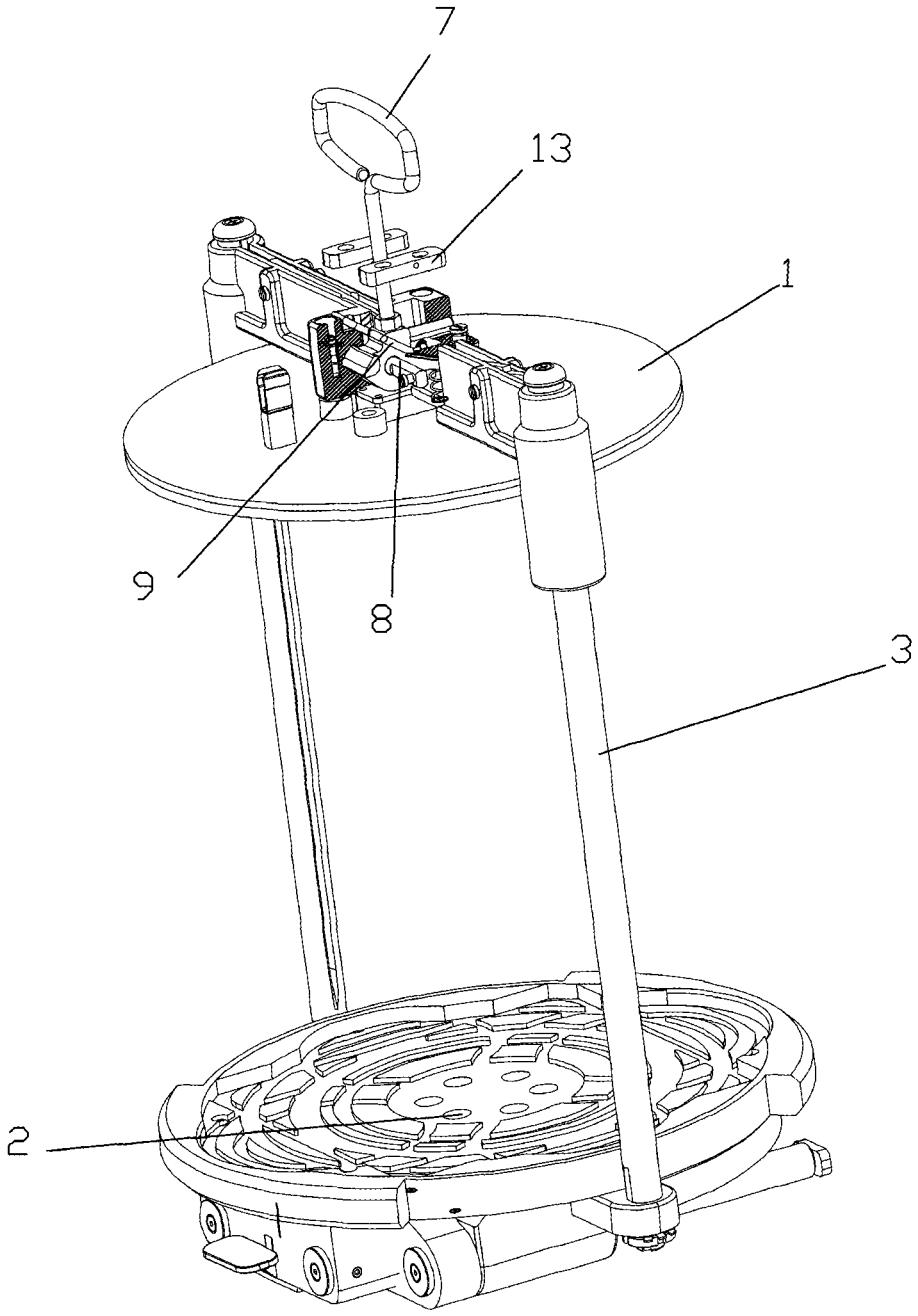
FIG. 8 is an isometric view of the pressing and fixing device of FIG. 6 in an opened state (cut-away view)
Figure 10:
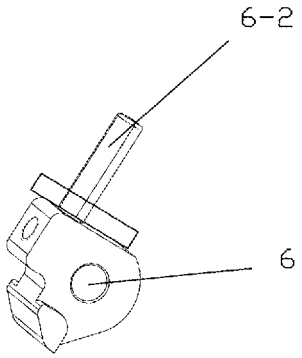
FIG. 10 is an isometric view of a cam structure provided with a pressing pole.

In another solution for unlocking the upper pressing plate from the guide rail by the locking piece, the cam structure shown in FIG. 10 is provided in an embodiment of the present application, with the assembled structure being shown in FIGS. 6 to 8. In the present structure, a U-shaped pressing pole may be mounted in the upper pressing plate-fixing frame, and two ends of the U-shaped pressing pole pass through and are mounted in the holes of the upper pressing plate-fixing frame. The U-shaped pressing pole is rotatable in the upper pressing plate-fixing frame. A part of the U-shaped pressing pole is located above the distal ends of the locking pieces, and is cooperated with the locking pieces in sliding friction manner. A pressing pole 6-2 is mounted on the cam structure, and is positioned such that, when the cam handle is rotated upwardly, the bottom portion of the U-shaped pressing pole is pressed by the pressing pole downwardly. With the linkage action, the distal end of the locking piece is pressed by the U-shaped pressing pole when the bottom portion of the U-shaped pressing pole is pressed by the pressing pole. The rotation travel of the cam handle causes the locking piece to be in unlocking state, and the pressing pole is cooperated with the bottom portion of the U-shaped pressing pole in sliding friction manner.

Figure 11:
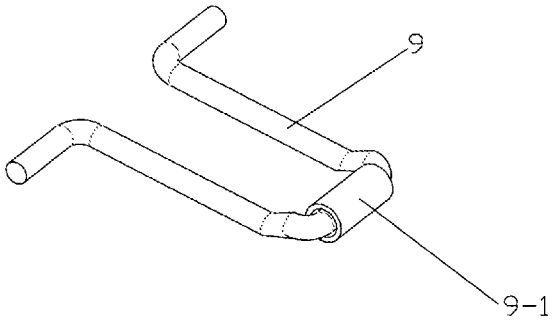
FIG. 11 is an isometric view of a U-shaped pressing pole.
Figure 12:
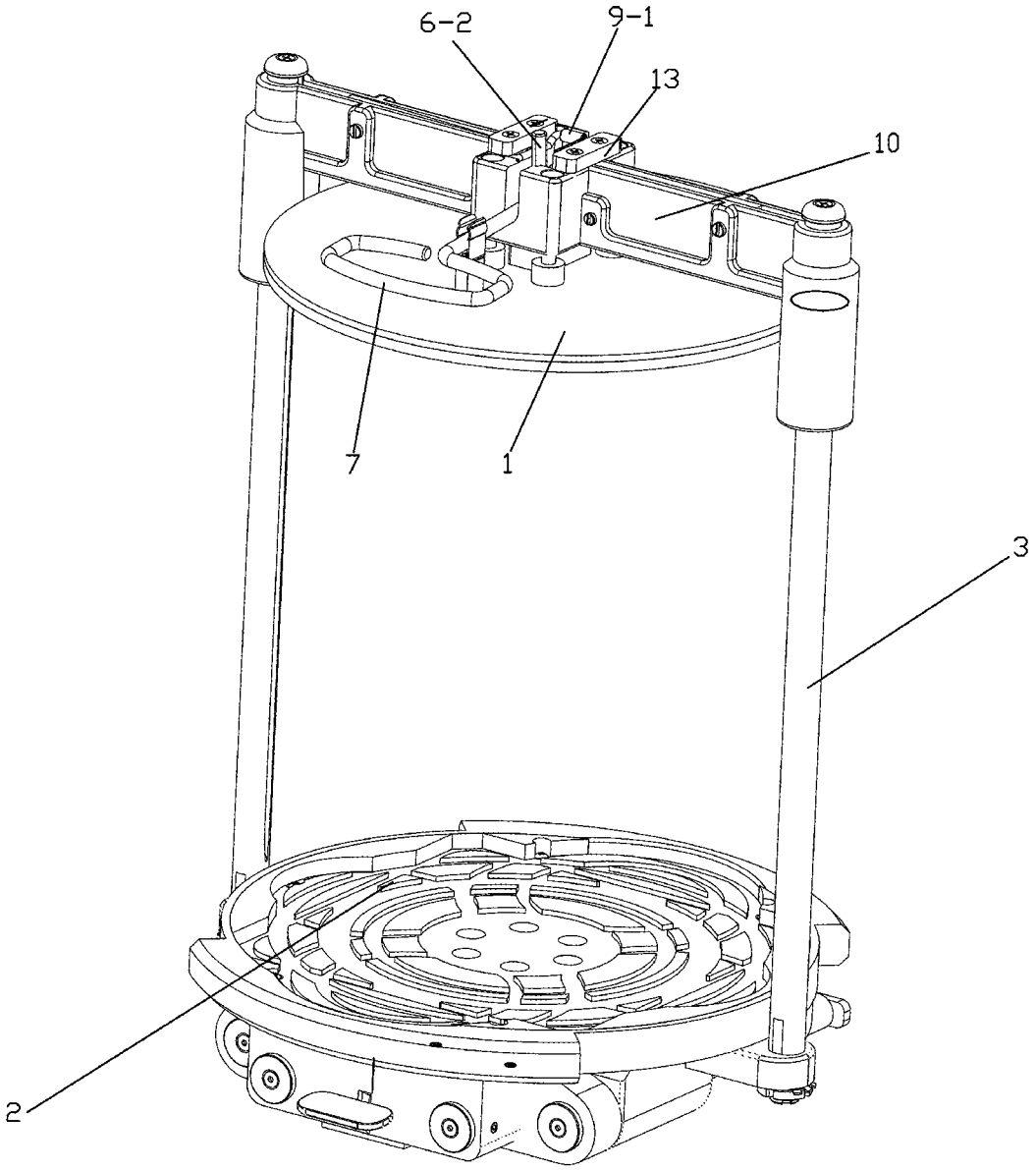
FIG. 12 is an isometric view showing a contour of another pressing and fixing device according to the present application (as shown in FIG. 6).

In the present embodiment, a rotary sleeve member (as shown in FIG. 11) may be mounted on the U-shaped pressing pole at the position where the pressing pole is in friction with the U-shaped pressing pole, so as to create the sliding friction more effectively.

The invention claimed is:

1. A paint can-clamping device applicable to a double-gyroscopic mixer, comprising a lower supporting plate, left and right guide rails fixed on the lower supporting plate, and an upper pressing plate mounted on the left and right guide rails via a locking mechanism and being movable up and down along the guide rails, wherein the locking mechanism comprises an upper pressing plate-fixing frame, locking pieces, and a locking piece spring;

the locking pieces are located in the upper pressing plate-fixing frame, a front end of each of the locking pieces is in contact cooperation with the corresponding guide rail and has an arc surface, a rotary shaft passes through and is mounted in the front end of each of the locking pieces, the arc surface of the front end of each of the locking pieces is eccentric with respect to the rotary shaft at the front end of the locking piece such that the arc surface of the front end of the locking piece is rotatable eccentrically about the rotary shaft at the front end of the locking piece; and the locking pieces each are in friction cooperation with a V-shaped groove in the respective guide rails, and wherein the upper pressing plate is connected to the upper pressing plate-fixing frame via a guide pole, such that the upper pressing plate is movable linearly with respect to the upper pressing plate-fixing frame along an axis direction of the guide pole; a cam structure having a cam handle is mounted in the upper pressing plate-fixing frame, and the cam structure is cooperated, via a cam pressing mechanism for pressing the locking pieces downwardly, with the locking piece, such that the locking pieces move away from the V-shaped grooves of the guide rails to be in unlocking state, thereby achieving a linear movement of the upper pressing plate along the guide rails.

2. The paint can-clamping device applicable to the double-gyroscopic mixer according to claim 1, wherein the upper pressing plate is connected to the upper pressing plate-fixing frame via four symmetrical guide poles, the guide poles are fixed on the upper pressing plate, and each of the guide poles is provided thereon with a spring.

3. The paint can-clamping device applicable to the double-gyroscopic mixer according to claim 1, wherein the cam structure is fixedly mounted, via a rotary shaft, on the upper pressing plate-fixing frame and is rotatable about the rotary shaft.

4. The paint can-clamping device applicable to the double-gyroscopic mixer according to claim 1, wherein the cam pressing mechanism for pressing the locking pieces downwardly comprises the cam structure and a flange provided on the cam structure and extending towards two sides of the cam structure, and the flange is cooperated with a distal end of each of the locking pieces in a sliding friction manner.

5. The paint can-clamping device applicable to the double-gyroscopic mixer according to claim 1, wherein the cam pressing mechanism for pressing the locking pieces downwardly comprises a pressing pole mounted on the cam structure and a U-shaped pressing pole mounted in the upper pressing plate-fixing frame, two ends of the U-shaped pressing pole are rotatable in the upper pressing plate-fixing frame, and the U-shaped pressing pole is cooperated with a distal end of each of the locking pieces in sliding friction manner.

* * * * *